US005145525A

United States Patent [19]

Fromm et al.

[11] Patent Number: 5,145,525

[45] Date of Patent: Sep. 8, 1992

[54] OIL HANDLING AROUND A METERING ROLL

[75] Inventors: Paul M. Fromm, Rochester; Alvin D. Kromm, Jr., Webster; Jeffrey B. Levy, Pittsford, all of N.Y.

[73] Assignee: Xerox Corporation, Stamford, Conn.

[21] Appl. No.: 594,759

[22] Filed: Oct. 9, 1990

[51] Int. Cl.[5] ..... B05C 1/06

[52] U.S. Cl. ..... 118/260; 118/264; 118/268; 118/270; 118/60; 118/101

[58] Field of Search ..... 118/60, 101, 260, 264, 118/268, 270

[56] References Cited

U.S. PATENT DOCUMENTS

| | | | |
|---|---|---|---|
| 4,158,495 | 6/1979 | Seelenbinder et al. | 118/260 |
| 4,214,549 | 7/1980 | Moser | 118/60 |
| 4,573,428 | 3/1986 | Ogino et al. | 118/60 |
| 4,633,805 | 1/1987 | Katsuya et al. | 118/101 |

*Primary Examiner*—W. Gary Jones
*Assistant Examiner*—Brenda Lamb

[57] ABSTRACT

Release Agent Management (RAM) system for a heat and pressure fuser. The open pool of oil associated with prior art RAM systems is replaced with an oil saturated wick the lower end of which is immersed in oil. The oil is held in a container with a sealed lid that has a slot through which the wick passes allowing the wick to transport oil from the container to a metering roll outside of the container. A depression in the container lid that cradles the wick under the metering roll allows oil to collect in the portion of the wick laying on the container lid. The shape of the depression prevents oil from flowing back into the container through the slot and from flowing to some lower part of the container lid. The wick is compressed approximately 50% between the metering roll and container lid. A removable seal is provided which is attached to the lid such that the RAM can be shipped without oil spillage.

22 Claims, 2 Drawing Sheets

OIL HANDLING AROUND A METERING ROLL

BACKGROUND OF THE INVENTION

This invention relates generally to xerographic copying apparatus, and more particularly, it relates to the heat and pressure fixing of particulate thermoplastic toner by direct contact with a heated fusing member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner liquefy and cause a splitting action in the molten toner resulting in "hot offset." Splitting occurs when the cohesive forces holding the viscous toner mass together is less than the adhesive forces tending to offset it to a contacting surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting," has been to provide a fuser roll with an outer surface or covering of polytetrafluoroethylene, known by the trademark "Teflon" to which a release agent such as silicone oil is applied, the thickness of the "Teflon" being on the order of several mils and the thickness of the oil being less than 1 micron. Alternatively, a thin layer of silicone rubber 5–10 mils thick may be used. A silicone rubber layer provides conformability with the paper roughness resulting in more uniform fixing and image gloss. Silicone based (polydimethylsiloxane) oil which possess a relatively low surface energy, have been found to be materials that are suitable for use in the heated fuser roll environment where "Teflon" constitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

A fuser roll construction of the type described above is fabricated by applying in any suitable manner a solid layer of abhesive material to a rigid core or substrate such as the solid "Teflon" outer surface or covering of the aforementioned arrangement.

Donor roll RAM (release agent management) systems have been used as part of roll fuser apparatus for some time. Such a RAM system is disclosed in U.S. Pat. No. 4,214,549 issued on Jul. 29, 1980 to Moser. This patent illustrates a heat and pressure roll fusing apparatus for fixing toner images to copy substrates, the toner comprising a thermoplastic resin. The apparatus includes an internally heated, fuser roll cooperating with a backup or pressure roll to form a nip through which the copy substrates pass with the images contacting the heated roll. The pressure roll is the softer of the two rolls, therefore, the nip is formed by the harder fuser roll indenting the softer pressure roll. The heated fuser roll is characterized by an outer layer or surface which by way of example is fabricated from a silicon rubber or Viton material to which a low viscosity polymeric release fluid is applied. Release fluid is contained in a sump from which it is dispensed by means of a metering roll and a donor roll, the former of which contacts the release fluid in the sump and the latter of which contacts the surface of the heated fuser roll. The oil picked up by the metering roll after it is rotated through the release fluid oil is metered to a very thin film on the metering roll by a metering blade.

In many applications oil is pumped into a trough wherein it saturates and covers a swipper wick. The metering roll is then loaded to interfere with the swipper wick. The function of the wick is to prevent air entrapment between the moving metering roll and the stationary oil. In the above described designs the oil flow pattern must accommodate large quantities of oil that are pumped by the metering roll up to the metering blade and then metered off the rolls. With tight space constraints this can be a challenge.

In a configuration where the roll enters a pool of oil, the roll ends get coated with a thick film of oil. During steady running this excess oil can get onto the donor roll if it is longer than the metering roll. If the metering roll is the longest roll then running problems are avoided but standby and startup problems occur. Oil that is on the roll end, above the metering blade, flows down to the blade and is wicked axially down the blade-roll contact capillary. This results in excess oil being applied to the fuser roll. The problems associated with oil on the roll ends are commonly referred to as oil slinging.

Heretofore, an unnecessary amount of handling of the oil of such RAM systems has been required and the open pool of oil associated with such systems can be easily spilled. The foregoining renders such RAM systems undesirable.

BRIEF SUMMARY OF THE INVENTION

In accordance with the present invention, the open pool of oil associated with prior art RAM systems is replaced with an oil saturated wick the lower end of which is immersed in oil. The oil is held in a container with a sealed lid that has a slot through which a wick passes allowing the wick to transport oil from the container to a metering roll outside of the container. A depression in the container lid that cradles the wick under the metering roll allows oil to collect in the portion of the wick laying on the container lid. The shape of the depression prevents oil from flowing back into the container through the slot and from flowing to some lower part of the container lid. The wick is compressed approximately 50% between the metering roll and container lid.

The slot in the container lid is disposed to the side of the metering roll adjacent the entrance to the nip formed between the metering roll and the wick. A portion of the wick adjacent the exit end of the aforementioned nip is uncompressed.

The position of the metering blade is such that oil metered off the metering roll flows into the depression in the container lid. The metering blade is longer than the metering roll and the wick is approximately 12 mm (6 mm at each end) shorter than the metering roll. Also, the metering roll is longer than the roll it engages.

An area around the wick depression has a plastic film sealed to it to provide an oil tight member that will allow shipment of new oil containers without oil spillage.

DETAILED DESCRIPTION OF THE PREFERRED EMBODIMENT OF THE INVENTION

Figure 1:
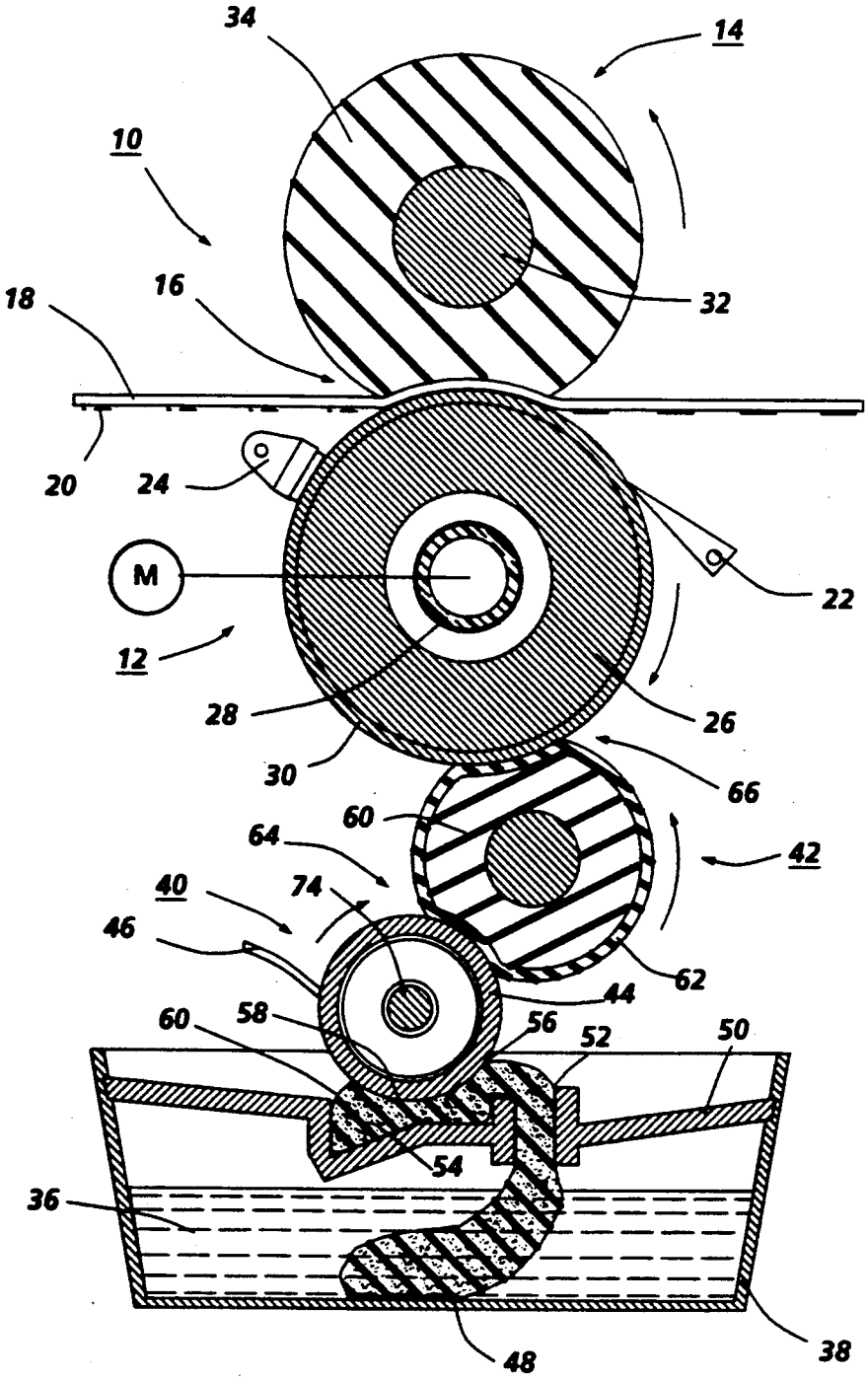
FIG. 1 schematically illustrates a heat and pressure fuser and Release Agent Management (RAM) system representing the present invention.
Figure 2:
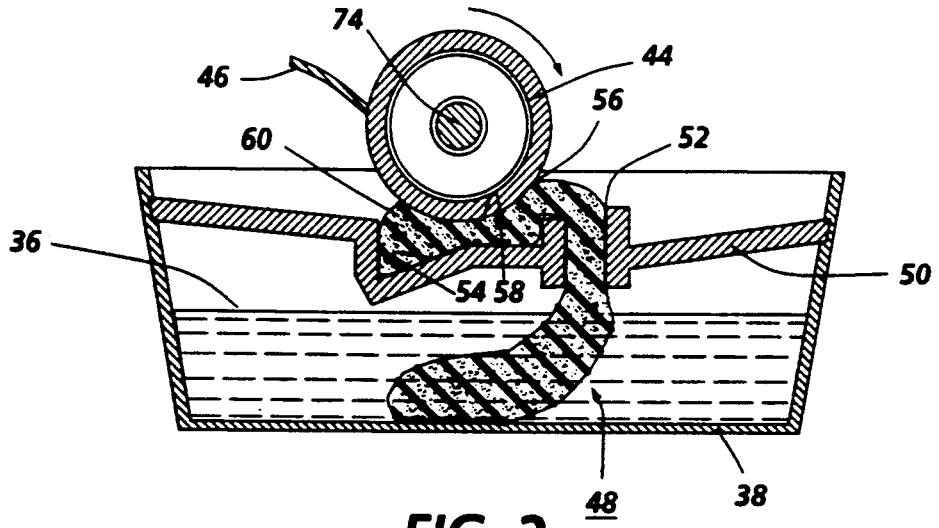
FIG. 2 schematically illustrates the major components of the RAM system of this invention.

FIG. 1 illustrates a heat and pressure fuser apparatus generally indicated 10. The fuser apparatus comprises a heated roll structure 12 cooperating with a non-heated backup roll structure 14 to form a nip 16 through which a copy substrate 18 passes with toner images 20 formed thereon in a well known manner. The toner images 20 contact the heated roll structure while a force is applied between the roll structures in a well known manner to create pressure therebetween resulting in the deformation of the backup roll structure by the heated roll structure to thereby form the nip 16.

As the substrate 18 passes out of the nip, it is stripped from the heated roll structure by a plurality (only one shown) of stripping devices 22 after which it is free to move along a predetermined path toward the exit of the machine (not shown) in which the fuser apparatus 10 is to be utilized.

A contact temperature sensor 24 is provided for sensing the surface temperature of the roll structure 12 and in conjunction with conventional circuitry (not shown) maintains the surface temperature to a predetermined value, for example, on the order of 375°–400° F.

The heated roll structure 12 comprises a hollow cylinder 26 having a radiant quartz heater 28 disposed in the hollow thereof. When suitably energized via the aforementioned circuitry, the heating element radiates heat to the cylinder which is then conducted to the outer surface of an outer layer 30 of the structure 12 which may comprise Viton having a thickness of 0.008 inch, silicone rubber having a thickness of 0.005–0.010 inch or Teflon having a thickness of 0.001–0.005.

The backup roll structure 14 comprises a solid metal core 32 to which is adhered a relatively thick layer 34 of deformable material for example an elastomer known as ethylene-propylene terpolymer which is based on stereosperific linear terpolymers of ethylene, propylene and small amounts of non-conjugated diene which is commonly referred to as EPDM which layer carries a thin overcoat of PFA or a thick layer of silicone rubber. Due to the construction of the backup roll structure it is deformed by the harder heated roll structure when the required pressure is applied therebetween, the pressure being a function of the desired deformation which corresponds to the desired length of the nip 16. While the layer 30 tends to be abhesive, therefore, exhibits a low affinity for the toner material 20, it has been found desirable to coat the layer with a release agent material 36 held in a container 38. The material 36 may comprise a polymeric release agent having functional groups such as carboxy, hydroxy, epoxy, ammo, isogenate, thioether or mercepto groups. In the case of Teflon or silicone rubber layer 30 the functional group is not needed. In any event, the oil viscosity is in the order of 100–250 cs.

For the purpose of coating the heated roll structure 12 there is provided a Release Agent Management (RAM) system generally indicated 40. The RAM system 40 comprises a donor roll 42, metering roll 44, doctor blade 46 and a wick 48. The metering roll 44 is rotatably supported in contact with one end of the wick 48. The other end of the wick is immersed in the release agent material in the container 38.

The container 38 includes a sealed lid 50 that has a slot 52 through which the wick 48 passes allowing the wick to transport oil from inside the container to the metering roll 44 outside of the container. A depression 54 in the container lid that cradles a portion of the wick under the metering roll allows oil to collect in the portion of the wick laying on the container lid. The shape of the depression prevents oil from flowing back into the container through the slot and from flowing to some lower part of the container lid. The wick is compressed approximately 50% between the metering roll and container lid. The wick is fabricated from medium density, non woven (weaved) nomex fibers typical of other Nomex fibers used in heat and pressure fusers for applying oil to the fuser rolls.

The slot in the container lid is disposed to the side of the metering roll adjacent entrance 56 to nip 58 formed between the metering roll and the lid. A portion 60 of the wick adjacent the exit end of the aforementioned wick is uncompressed.

Figure 3:
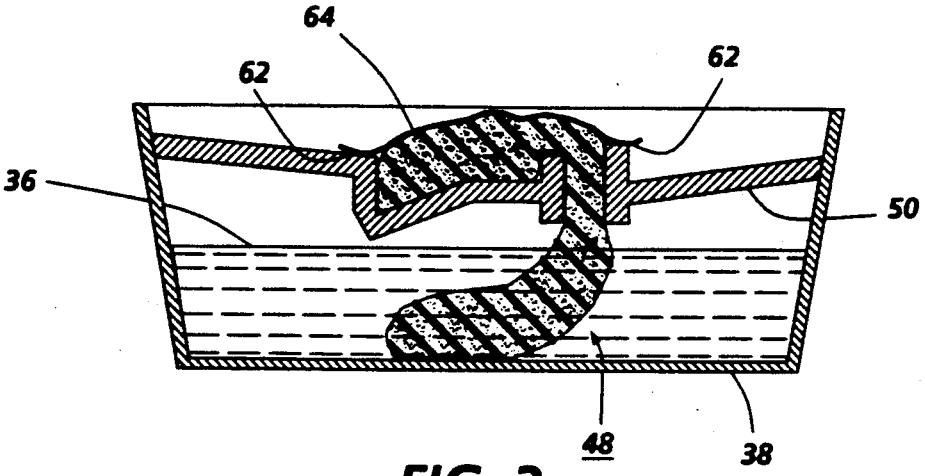
FIG. 3 schematically illustrates another view of the RAM system of FIG. 2.

As shown in FIG. 3, an area 62 surrounding the wick resting on top of the lid 50 has a plastic film or seal 64 attached to it to provide an oil tight member that will allow shipment of new oil containers without oil spillage.

The metering roll is preferably a steel-surfaced roll having a 4–32 AA finish. The metering roll has an outside diameter of 0.5–1.5 inch. As mentioned above, the metering roll is supported for rotation, such rotation being derived by means of the positively driven heated roll structure 12 via the rotatably supported donor roll 42. In order to permit rotation of (at a practical input torque to the heated roll structure 12 of the metering roll 14 in this manner the donor roll 42 comprises a deformable base layer 60 and outer layer 62 which form a first nip 64 between the metering roll and the donor roll and a second nip 66 between the latter and the heated roll. The nips 64 and 66 also permit satisfactory release agent transfer between the rolls and roll structure. Suitable nip lengths are 0.10 inch.

Figure 4:
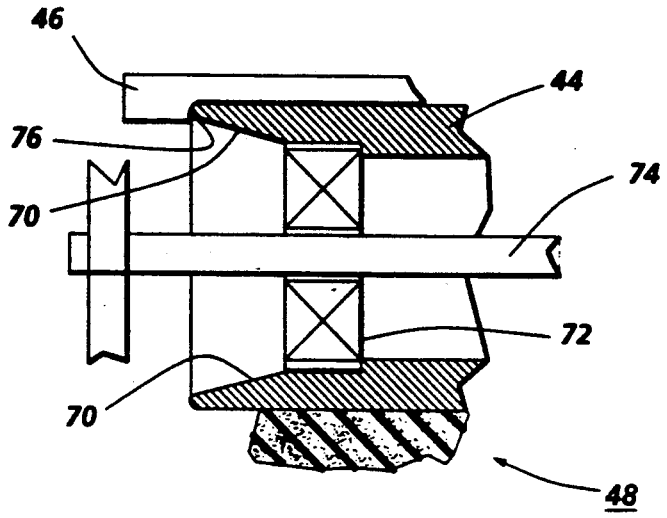
FIG. 4 is a enlarged fragmentary view of the ends of a wick, metering roll and metering blade.

The position of the metering blade 46 is such that oil metered off the metering roll flows into the depression 54 in the container lid. The metering blade is longer (FIG. 4) than the metering roll and the wick is approximately 12 mm (6 mm at each end) shorter than the metering roll. Also, the metering roll is longer than the donor roll it engages. As illustrated in FIG. 4, the ends of the metering roll 44 are tapered as indicated by reference character 70. The metering roll is rotatably supported by bearings 72 (only one shown) which, in turn, are supported by a fixed shaft 74. The ends of the metering roll 44 are rounded as indicated by reference character 76 thus providing a smooth area of contact between the confomable cleaning blade 46 and the metering roll 44 to prevent degradation of the blade by the metering roll.

What is claimed is:

1. Release Agent Management system for use a in roll fuser apparatus system comprising:

a container of release agent fluid;

a lid adhered to the top of said container such that release agent fluid cannot pass directly between said lid and said container, said lid having an elongated opening therein and a depression;

an elongated wick extending through said opening and having one end thereof immersed in said release agent fluid and the other end supported by said lid said other end being supported in contact with said lid in said depression; and means contacting said other end of said wick for transporting release agent fluid from said wick, said depression serving to contain any release agent material not transported by said means contacting said wick and not retained in said wick to thereby maintain contact of said other end and release agent contained in said depression.

2. Apparatus according to claim 1 including a manually removable seal attached to said lid such that release agent fluid is prevented from leaking from said container and said wick.

3. Apparatus according to claim 1 wherein said means contacting said wick comprises a metering roll structure.

4. Apparatus according to claim 3 wherein the width of said wick is shorter than the length of said metering roll structure.

5. Apparatus according to claim 4 including a metering blade contacting said metering roll structure, said metering blade being longer than said metering roll structure.

6. Apparatus according to claim 5 wherein said means contacting said wick further includes a donor roll structure.

7. Apparatus according to claim 6 wherein said donor roll structure is shorter than said metering roll structure.

8. Apparatus according to claim 7 wherein said metering roll structure compresses said wick approximately 50%.

9. Apparatus according to claim 8 wherein the rotation of said metering roll is such that the entrance to the nip between said metering roll structure and said wick is adjacent said elongated opening.

10. Apparatus according to claim 9 wherein the edges of said metering roll structure are rounded and said metering blade is loaded against said metering roll structure thereby causing the portions of said blade extending beyond said metering roll structure to contact the ends of said metering roll structure.

11. Apparatus according to claim 5 wherein said metering blade contacts said metering roll at a location such that oil metered therefrom flows into said depression in said lid.

12. Fuser apparatus, said apparatus comprising:

a heated roll structure;

a pressure roll structure cooperating with said heated roll structure to form a nip through which copy substrates pass with toner images carried thereby contacting said heated roll structure;

a container of release agent fluid;

a lid adhered to the top of said container such that release agent fluid cannot pass directly between said lid and said container, said lid having an elongated opening therein and a depression;

an elongated wick extending through said opening and having one end thereof immersed in said release agent fluid and the other end supported by said lid said other end being supported in contact with said lid in said depression and means contacting said said other end of said wick for transporting release agent fluid from said wick, said depression serving to contain any release agent material not transported by said means contacting said wick and not retained in said wick to thereby maintaining contact of said said other end and release agent contained in said depression.

13. Apparatus according to claim 12 including a removable seal attached to said lid such that release agent fluid is prevented from leaking from said container and said wick.

14. Apparatus according to claim 12 wherein said means contacting said wick comprises a metering roll structure.

15. Apparatus according to claim 14 wherein the width of said wick is shorter than the length of said metering roll structure.

16. Apparatus according to claim 15 including a metering blade contacting said metering roll structure, said metering blade being longer than said metering roll structure.

17. Apparatus according to claim 16 wherein said means contacting said wick further includes a donor roll structure.

18. Apparatus according to claim 17 wherein said donor roll structure is shorter than said metering roll structure.

19. Apparatus according to claim 18 wherein said metering roll structure compresses said wick approximately 50%.

20. Apparatus according to claim 19 wherein the rotation of said metering roll is such that the entrance to the nip between said metering roll structure and said wick is adjacent said elongated opening.

21. Apparatus according to claim 20 wherein the edges of said metering roll structure are rounded and said metering blade is loaded against said metering roll structure thereby causing the portions of said blade extending beyond said metering roll structure to contact the ends of said metering roll structure.

22. Apparatus according to claim 16 wherein said metering blade contacts said metering roll at a location such that oil metered

* * * * *